United States Patent [19]

Horie et al.

[11] Patent Number: 5,035,968

[45] Date of Patent: Jul. 30, 1991

[54] ELECTROPHOTOGRAPHIC PHOTORECEPTOR WITH PHTHALOCYANINE IN STYRENEMALEIC ANHYDRIDE HALF-ESTER BINDER

[75] Inventors: Seiji Horie; Naonori Makino, both of Kanagawa, Japan

[73] Assignee: Fuji Photo Film Co., Ltd., Kanagawa, Japan

[21] Appl. No.: 391,018

[22] Filed: Aug. 9, 1989

[30] Foreign Application Priority Data

Aug. 9, 1988 [JP] Japan ..... 63-198668

[51] Int. Cl.[5] ..... G03G 5/087; G03G 5/047

[52] U.S. Cl. ..... 430/58; 430/59; 430/96

[58] Field of Search ..... 430/58, 59, 96

[56] References Cited

U.S. PATENT DOCUMENTS 4,461,818 7/1984 Suzuki et al. ..... 430/49
4,477,547 10/1984 Yamada et al. ..... 430/49 X
4,500,617 2/1985 Nakayama ..... 430/49
4,518,668 5/1985 Nakayama ..... 430/49
4,520,088 5/1985 Senga et al. ..... 430/49
4,710,446 12/1987 Hoffmann et al. ..... 430/302 X

*Primary Examiner*—Roland Martin
*Attorney, Agent, or Firm*—Sughrue, Mion, Zinn, Macpeak & Seas

[57] ABSTRACT

An electrophotographic photoreceptor comprising an electrically conductive support and, formed thereon, at least a charge generating layer and a charge transporting layer, the charge generating layer containing a phthalocyanine pigment and, as a resin binder, at least one copolymer which comprises as recurring units at least styrene units and maleic anhydride half ester units represented by the following general formula (I):

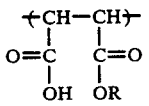

(I)

wherein R represents an alkyl group or an aryl group. The electrophotographic photoreceptor has high sensitivity and excellent durability.

9 Claims, No Drawings

ELECTROPHOTOGRAPHIC PHOTORECEPTOR WITH PHTHALOCYANINE IN STYRENEMALEIC ANHYDRIDE HALF-ESTER BINDER

FIELD OF THE INVENTION

This invention relates to an electrophotographic photoreceptor comprising an electrically conductive support and, formed thereon, a photosensitive layer which is of a layered structure consisting of a charge generating layer and a charge transporting layer.

BACKGROUND OF THE INVENTION

Electrophotographic photoreceptors are required to have, for example, the following basic properties: (1) they should be able to be charged in the dark to a proper potential; (2) dissipation of the charge in the dark should be little; and (3) they should be able to quickly dissipate the charge upon exposure to light.

Conventionally used electrophotographic photoreceptors employing inorganic substances such as selenium, cadmium sulfide and zinc oxide have many advantages. At the same time, however, they also have various disadvantages. For example, selenium photoreceptors, which are being widely used and fully satisfy the above requirements (1) to (3), are disadvantageous in that the conditions for their preparation are complicated, their production costs are high, they lack flexibility so that they are difficult to prepare into a belt configuration, and they should be carefully handled because of their sensitiveness to heat and mechanical shock. Cadmium sulfide photoreceptors and zinc oxide photoreceptors, which employ cadmium sulfide or zinc oxide dispersed in resin binders, cannot be readily used in a repetitive cyclic operation since they lack smoothness and are poor in mechanical properties such as hardness, tensile strength and abrasion resistance.

In recent years, electrophotographic photoreceptors employing various organic substances have been suggested in order to eliminate the disadvantages of the conventional photoreceptors employing the above mentioned inorganic substances, and some of these have been put to practical use. For example, there may be mentioned an electrophotographic photoreceptor comprising poly-N-vinylcarbazole and 2,4,7-trinitrofluoren-9 one (U.S. Pat. No. 3,484,237), an electrophotographic photoreceptor comprising poly-N-vinylcarbazole sensitized with a pyrylium salt-based dye (JP B-48-25658), an electrophotographic photoreceptor comprising an organic pigment as the principle component (JP-A-47-37543), and an electrophotographic photoreceptor in which the principle component is a co-crystalline complex consisting of a dye and a resin (JP-A-47-10785). (The terms "JP-A" and "JP-B" as used herein mean an "unexamined published Japanese patent application" and an "examined Japanese patent publication" respectively.)

Furthermore, there has also been proposed an electrophotographic photoreceptor comprising copper phthalocyanine dispersed in a resin (JP-B-52-1667).

Although these organic electrophotographic photoreceptors possess somewhat improved mechanical properties and flexibility as compared with the aforementioned inorganic electrophotographic photoreceptors, they generally have poor photosensitivities and are unfit for use in repetitive operations. Hence, these organic photoreceptors cannot fully meet the requirements for electrophotographic photoreceptors.

Meanwhile, the process of photoconduction in electrophotographic photoreceptors consists of (1) a step in which the photoreceptors generate an electrical charge upon exposure to light, and (2) a step in which the photoreceptors transport the charge.

As an example in which the steps (1) and (2) proceed in a single material, there may be mentioned the selenium photoconducting plate. On the other hand, a well known example in which the steps (1) and (2) proceed in separate materials is a photoconductor employing the combination of amorphous selenium and poly-N-vinylcarbazole. The function-divided electrophotographic photoreceptor in which the steps (1) and (2) are allowed to proceed in separate materials is advantageous in that materials therefor can be selected from a wide range and, hence, the electrophotographic properties such as sensitivity and potential acceptability of the resulting electrophotographic photoreceptors can be improved, and further that materials advantageous for preparing coatings of electrophotographic photoreceptors can be selected from wide ranges.

Many types of such function-divided electrophotographic photoreceptors have so far been proposed. Recently, however, extensive studies are being conducted in order to develop a layered photoreceptor comprising two layers consisting of a charge generating layer which serves to absorb light and generate a charge and a charge transporting layer which serves to transport the charge generated.

The charge generating layer is basically composed of a charge generating material which absorbs light and generates a charge carrier, and a resin binder. In electrophotographic processes, the charge generating layer is required to have high photosensitivity, the fluctuation in potential is required to be small throughout repetitive use, and further the charge carrier generated in the charge generating layer should be efficiently injected into the charge transporting layer. The resin binder containing the charge generating material dispersed therein greatly affects the transport of generated charge carriers depending upon the chemical structure, molecular weight, purity, etc. of the resin binder.

As resin binders for charge generating layers, a polyester resin is being used which is combined with an azo pigment (JP-A-54-22834). Further, there have also been proposed, for example, a hydroxypropyl cellulose resin (JP-A-57-169754), a resin of a fatty acid ester with cellulose (JP-A-58-166353), an acrylic resin (JP-A-58-192040), a polyvinyl butyral resin used in combination with a polyamide undercoat (JP-A-58-30757), a linear polyester resin combined with an undercoat of a polyamide copolymer (JP-A-58-93739), and a phenoxy, polyvinyl formal or ethyl cellulose resin combined with an alcohol-soluble nylon undercoat (JP-A-60-196766, JP-A-60-202448 and JP-A60-202449).

However, electrophotographic photoreceptors employing these resin binders for their charge generating layers are still insufficient in sensitivity and durability and, hence, a further improvement has been demanded.

SUMMARY OF THE INVENTION

It is, therefore, an object of the present invention to provide an electrophotographic photoreceptor which is excellent in sensitivity and durability.

The foregoing and other objects, features and advantages of the present invention will be apparent from the following detailed description.

According to the present invention, there is obtained an electrophotographic photoreceptor having high sensitivity and excellent durability owing to its charge generating layer which employs a phthalocyanine pigment as a charge generating material and, as a resin binder, a copolymer of styrene and a half ester of maleic anhydride.

That is, the electrophotographic photoreceptor of the invention comprises an electrically conductive support and, formed thereon, at least a charge generating layer and a charge transporting layer, said charge generating layer containing a phthalocyanine pigment and, as a resin binder, at least one copolymer which comprises as recurring units at least styrene units and maleic anhydride half ester units represented by the following general formula (I)

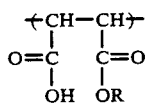

(I)

wherein R represents an alkyl group or an aryl group.

In the formula (1), the alkyl group and the aryl group may have other substituent groups.

DETAILED DESCRIPTION OF THE INVENTION

As specific examples of the alkyl group represented by R, there may be mentioned a methyl, ethyl, n-propyl, isopropyl, n-butyl, isobutyl, n-hexyl and cyclohexyl group. The alkyl group contains 1 to 18 carbon atoms.

Specific examples of the aryl group represented by R include a phenyl, naphthyl, anthranyl and phenanthranil group. The aryl group contains 6 to 14 carbon atoms.

Where R is an alkyl group having a substituent group, examples of the substituent group include a halogen atom (for example, fluorine, chlorine, or bromine), a trifluoromethyl group, a nitro group, an amino group, a dialkylamino group (for example, diethylamino), a carboxyl group, a sulfonic acid group, an alkoxy group (for example, methoxy, ethoxy, butoxy), an aryl group and a cyano group.

Where R is an aryl group having a substituent group, examples of the substituent group include the same substituent groups as those mentioned just above with reference to the case where R is an alkyl group having a substituent group, and also include a lower alkyl group having 1 to 6 carbon atoms.

The position and number of such a substituent group are not limited.

In the copolymer employed in this invention, i.e., a copolymer of styrene and a half ester of maleic anhydride, the content of maleic anhydride half ester units in the copolymer is preferably in the range of from 5 mol% to 95 mol%, more preferably from 20 mol% to 70 mol%. The content of styrene units is preferably in the range of from 5 mol% to 95 mol%, more preferably from 20 mol% to 70 mol%.

A preferred molecular weight of the copolymer is from 1,000 to 300,000, and especially from 10,000 to 150,000.

The resin binder employed in the present invention can be prepared through the following two-step process.

In first step of the process, styrene and a maleic acid compound are copolymerized. For this polymerization, a known method can be employed such as solution polymerization, suspension polymerization, precipitation polymerization or emulsion polymerization. In the case of solution polymerization, for example, the monomers in predetermined proportions are added to a medium such as benzene or toluene, and then a polymerization is performed with the aid of a radical polymerization initiator such as azobisisobutyronitrile, benzoyl peroxide or lauryl peroxide, thereby to obtain a copolymer solution. This copolymer solution is dried, or is added to a poor solvent, whereby a desired copolymer can be obtained. In the case of suspension polymerization, the monomers are dispersed in a medium in the presence of a dispersing agent such as polyvinyl alcohol or polyvinyl pyrrolidone, and the monomers are then copolymerized in the presence of a radical polymerization initiator, thereby to obtain a copolymer. In these polymerizations, a chain transfer agent such as mercaptans including lauryl mercaptan may be used for regulating the molecular weights.

In the second step of the process, the unesterified copolymer as obtained in the first step described above is esterified with a compound having an alcoholic OH group in its molecule, thereby to obtain a resin binder to be employed in this invention.

The esterification can be performed by means of a general esterification reaction. For example, the unesterified copolymer is heated under reflux in an organic solvent (for example, a hydrocarbon such as benzene or toluene; a hologenated hydrocarbon such as chloroform, dichloromethane or chlorobenzene; or a ketone such as acetone, methyl ethyl ketone or cyclohexanone) or without a solvent, in the presence of a condensation catalyst (for example, a strong acid such as sulfuric acid, benzenesulfonic acid or p-toluenesulfonic acid; or a tertiary amine such as triethylamine, tributylamine or an N,N-dialkylaniline), thereby to perform esterification.

Alternatively, the resin to be employed in this invention may also be obtained by boiling maleic anhydride together with an alcohol to synthesize a monomeric half ester of maleic acid, and then copolymerizing this half ester monomer with styrene.

As examples of the alcohol which can be used for synthesizing the half ester from the styrene-maleic anhydride copolymer and as examples of the alcohol to be used for the synthesis of the maleic anhydride half ester monomer, there may be mentioned aliphatic and aromatic alcohols such as methanol, ethanol, n-propyl alcohol, isopropyl alcohol, n-butyl alcohol, sec-butyl alcohol, tert-butyl alcohol, hexyl alcohol, methylisobutylcarbinol, 2-ethylhexyl alcohol, n-octyl alcohol, lauryl alcohol, stearyl alcohol, benzyl alcohol, phenylethyl alcohol, oleyl alcohol and cyclohexanol.

In addition to the above, also useful are alcohols having a carboxyl group, i.e., hydroxycarboxylic acids, such as, for example, glycolic acid, lactic acid, $\beta$-hydroxypropionic acid and $\beta$-hydroxybutyric acid.

Specific examples of resins which can be use as the resin binder in this invention are as follows.

(1) n-Butyl cellosolve half-ester of a styrene-maleic anhydride copolymer (molar ratio 1/1)

. . . . trade name: SMA-1440 (manufactured by Arco Chemical Company)

(2) Isopropyl half-ester of a styrene-maleic anhydride copolymer (molar ratio 1/1)

.... trade name: SMA-17352 (manufactured by Arco Chemical Company)

(3) Methyl half-ester of a styrene-maleic anhydride copolymer (molar ratio 2/1) (acid value 182, molecular weight 34,000)

(4) n-Propyl half-ester of a styrene-maleic anhydride copolymer (molar ratio 2/1) (acid value 198, molecular weight 37,000)

(5) n-Dodecyl half ester of a styrene-maleic anhydride copolymer (molar ratio 2/1) (acid value 112, molecular weight 49,900)

(6) Benzyl half-ester of a styrene-maleic anhydride copolymer (molar ratio 3/1) (acid value 119, molecular weight 37,900)

(7) Copolymer of styrene and monooctyl maleate (molar ratio 60/40)

(8) Copolymer of styrene and mono-t-butyl maleate (molar ratio 70/30)

(9) Copolymer of styrene and monoethyl maleate (molar ratio 60/40)

(10) Copolymer of styrene and monolauryl maleate (molar ratio 50/50)

(11) Copolymer of styrene and mono (methylisobutylcarbinol)maleate (molar ratio 60/40)

(12) Copolymer of styrene and mono-sec-butyl maleate (molar ratio 70/30)

(13) Copolymer of styrene and monoisopropyl maleate (molar ratio 60/40)

(14) Copolymer of styrene and a monoester of maleic acid with glycolic acid (molar ratio 80/20)

The copolymer of styrene and a half ester of maleic anhydride to be employed in this invention can contain other recurring units (e.g, vinyl group, vinyl ether group) than styrene units and maleic anhydride half ester units. In this case, the content of maleic anhydride half ester is 5 mol% to 95 mol%. Furthermore, the resin binder to be employed in the invention can be a combination of the copolymer as described above with other general binders (eg., polyester, polycarbonate, vinyl chloride). The other general binder may be in the range of 5 to 95 wt%.

The phthalocyanine pigment to be employed in the charge generating layer according to the present invention may be any of the phthalocyanine pigments such as metal phthalocyanines, halogenated phthalocyanines and metalfree phthalocyanines. Especially, however, $\epsilon$-type copper phthalocyanine and aluminum chloride phthalocyanine give good results.

Aluminum chloride phthalocyanine, which is preferably employed in this invention, is represented by the following structural formula.

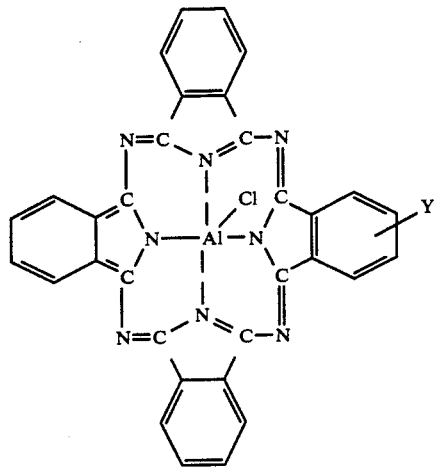

In the above formula, Y represents a hydrogen atom or a chlorine atom, and one of the benzene rings in aluminum chloride phthalocyanine may be monochlorinated.

Aluminum chloride phthalocyanine can easily be synthesized according to a known method. That is, it can be synthesized through condensation of phthalic anhydride with aluminum chloride and urea. This condensation is performed in the presence or absence of a catalyst, and phthalodinitrile can be used in place of the phthalic anhydride. Further, aluminum chloride phthalocyanine in which one of its benzene rings has been monochlorinated can easily be synthesized according to the method as described in JP-A-57-211149.

The charge transporting layer in the elctrophotographic phtoreceptor of this invention is basically composed of a charge transporting material, which transports a charge carrier generated in the charge generating layer, and a resin binder. Where the charge transporting material is a polymeric substance, a charge transporting layer may be composed of a charge carrier.

The compounds which transport charge carriers can generally be classified into two groups, i.e., those transporting electrons and those transporting positive holes, and either of the two groups can be employed in the electrophotographic photoreceptor of this invention.

As the compounds which transport electrons, there may be mentioned compounds having an electron attractive group. Examples of such compounds include 2,4,7-trinitro-9-fluorenone, 2,4,5,7-tetranitro-9-fluorenone, 9-dicyanomethylene-2,4,7-trinitrofluorenone, 9-dicyanomethylene-2,4,5,7-tetranitrofluorenone, tetranitrocarbazole, chloranil, 2,3-dichloro-5,6-dichanobenzoquinone, 2,4,7-trinitro-9,10-phenanthrenequinone, tetrachlorophthalic anhydride, tetracyanoethylene and tetracyanoquinodimethane.

As the compounds which transport positive holes, there may be mentioned compounds having an electron donative group. Examples of such compounds include: polymeric compounds such as (a) polyvinylcarbazole and derivatives thereof as disclosed in JP-B-34-10966, (b) the vinyl polymers, such as polyvinylpyrene, polyvinylanthracene, poly-2-vinyl-4-(4'-dimethylaminophenyl)-5-phenyloxazole and poly-3 vinyl-N-ethylcarbazole, as disclosed in JP-B-43-18674 and JP-B-43-19192, (c) the polymers such as polyacenaphthylene, polyindene and the copolymers of acenaphthylene and styrene as disclosed in JP-B-43-19193, (d) condensation resins such as pyrene-formaldehyde resins, bromopyrene formaldehyde resins and ethylcarbazole-formaldehyde resins as disclosed, for example, in JP-B-56-13940, (e) the various types of triphenylmethane polymers disclosed, for example, in JP-A-56-90883 and JP-A-56-161550; and low molecular weight compounds such as (f) the triazole derivatives disclosed, for example, in U.S. Pat. No. 3,112,197, (g) the oxadiazole derivatives disclosed, for example, in U.S. Pat. No. 3,189,447, (h) the imidazole derivatives disclosed, for example, in JP B-37-16096, (i) the polyarylalkane derivatives disclosed, for example, in U.S. Pat. Nos. 3,615,402, 3,820,989 and 3,542,544, JP-B-45-555, JP-B-51-10983, JP-A-51-93224, JP-A-55-108667, JP-A-55-156953 and JP-A-56- 36656, (j) the pyrazoline derivatives and pyrazolone derivatives as disclosed, for example, in U.S. Pat. Nos. 3,180,729 and 4,278,746, JP-A-55-88064, JP-A-55-88065, JP-A-49-105537, JP-A-55-51086, JP-A-56-88064, JP-A-56-88141, JP-A-57-45545, JP-A-54-112637 and JP-A-55-74546, (k) the phenylenediamine derivatives as disclosed, for example, in U.S. Pat. No. 3,615,404, JP-B-51-10105, JP-B-46-3712, JP-B-47-28336, JP-A-54-83435, JP-A-54-110836 and JP-A-54-119925, (l) the arylamine derivatives as disclosed, for example, in U.S. Pat. Nos. 3,567,450, 3,180,703, 3,240,597, 3,658,520, 4,232,103, 4,175,961 and 4,012,376, West German Patent (DAS) 1,110,518, JP-B-49-35702, JP-B-39-27577, JP-A-55-144250, JP-A-56-119132 and JP-A-56-22437, (m) the amino-substituted chalcone derivatives disclosed, for example, in U.S. Pat. No. 3,526,501, (n) the N,N-bicarbazyl derivatives disclosed, for example, in U.S. Pat. No. 3,542,546, (o) the oxazole derivatives disclosed, for example, in U.S. Pat. No. 3,257,203, (p) the styrylanthracene derivatives disclosed, for example, in JP-A-56-46234, (q) the fluorenone derivatives disclosed, for example, in JP-A-54-110837, (r) the hydrazone derivatives disclosed, for example, in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749 and JP-A-57-104144, (s) the benzidine derivatives disclosed, for example, in U.S. Pat. Nos. 4,047,948, 4,047,949, 4,265,990, 4,273,846, 4,299,897 and 4,306,008, and (t) the stilbene derivatives disclosed, for example, in JP-A-58-190953, JP-A-59-95540, JP-A-5997148, JP-A195658 and JP-A-62-36674.

In this invention, the charge carrier transporting material is not limited to the compounds listed under items (a) to (t) above, and any of the already known charge carrier transporting compounds can be employed.

It is also possible to combine two or more of these charge transporting materials according to need.

As the binder for the charge transporting layer, an electrically insulating film-forming macromolecular polymer which is hydrophobic and has a high dielectric constant is preferably employed. As examples of such a macromolecular polymer, the following may be mentioned, but the binder, of course, is not limited thereto.

Polycarbonates, polyesters, polyestercarbonates, polysulfone, methacrylic resins, acrylic resins, polyvinyl chloride, polyvinylidene chloride, polystyrene, polyvinyl acetate, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, styrene-maleic anhydride copolymers, phenoxy resins, polyvinyl butyral resins and poly-N-vinylcarbazole.

These polymers may be used alone or in combination of two or more thereof, as the resin binder for the charge transporting layer.

Furthermore, these polymers may also be used as the resin binder for the charge generating layer, in combination with the hereinbefore-described specific resin binder for the charge generating layer.

As the electrically conductive support in the electrophotographic photoreceptor of this invention, there may be employed a drum made of a metal such as aluminum, copper or stainless steel, or a sheet or film prepared by the vapor deposition of an electrically conductive material such as aluminum or $SiO_2$ on a sheet or film of a plastic such as polyester.

Also employed as the support is a plastic film or drum having a coating of an electrically conductive material such as a metal powder, carbon black, carbon fibers, copper iodide, $SnO_2$ or an electrically conductive polymer. According to need, such a conductive material in the coating on the film or drum may be in a dispersed state in a binder.

The thickness of the charge generating layer is generally 4 μm or smaller, preferably 2 μm or smaller, while the thickness of the charge transporting layer is generally from 3 to 30 μm, preferably from 10 to 20 μm.

The charge generating material is pulverized into a powder having particle diameters of 5 μm or less, preferably 1 μm or less, by merans of a dispersing machine such as a ball mill, a sand mill or a vibration mill, before being used for the charge generating layer.

In the electrophotographic photoreceptor of the present invention, the weight ratio of the charge generating material to the resin binder in the charge generating layer is preferably from 20:1 to 1:10, more preferably from 5:1 to 1:3. The weight ratio of the charge transporting material to the resin binder in the charge transporting layer is preferably from 5:1 to 1:10, more preferably from 2:1 to 1:5. In the case where the charge transporting material is a polymeric substance which itself can be used as a binder, the use of other resin binders is not necessary.

In preparing the elctrophotographic photoreceptor of this invention, additives such as a plasticizer and a sensitizer may be incorporated in the charge generating layer and the charge transporting layer. Further, a charge transporting compound may be incorporated in the charge generating layer.

As examples of such a plasticizer, there may be mentioned biphenyl, biphenyl chloride, o-terphenyl, p-terphenyl, dibutyl phthalate, dimethylglycol phthalate, dioctyl phthalate, triphenyl phosphate, methylnaphthalene, benzophenone, chlorinated paraffin, polypropylene, polystyrene, dilauryl thiodipropionate, 3,5-dinitrosalicylic acid and various fluorohydrocarbons.

In addition, silicone oil or the like may be incorporated for improving surface properties of the electrophotographic photoreceptor.

As sensitizers, chloranil and tetracyanoethylene may be mentioned.

According to need, an adhesive layer or a barrier layer may be formed between the electrically conductive support and the photosensitive layer. As a material for such a layer, use may be made of the macromolecular polymers which can be used as the afore-mentioned binders, gelatin, casein, polyvinyl alcohol, ethyl cellulose, carboxymethyl cellulose, the vinylidene chloride-based polymer latexes disclosed in JP-A-59-84247, the styrenebutadiene-based polymer latexes disclosed in JP-A-59-114544, or aluminum oxide. The layer thickness is preferably not more than 1 μm.

The electrophotographic photoreceptor of this invention, which has been described in detail hereinabove, generally has advantages of high sensitivity and excellent durability.

The electrophotographic photoreceptor of this invention can be used for many applications in the field of photoreceptors for not only electrophotographic copying machines but also the printers in which a laser or a Braun tube is used as a light source.

The present invention will now be illustrated in more detail with reference to the following Examples, which should not be construed to be limiting the scope of the invention. In the Examples, all "parts" are by weight.

EXAMPLE 1

5 parts of ϵ-type copper phthalocyanine (Liophoton ERPC, manufactured by Toyo Ink Mfg. Co., Ltd., Japan) and 15 parts of Resin (1), which was as produced by the process specified hereinbefore as an example of the resin binder to be employed in the present invention, were dispersed in 100 parts of a tetrahydrofuran solution by mixing them by means of a ball mill for 20 hours. The resulting dispersion was coated with a wire wound rod on an electrically conductive support (which had been prepared by forming a vapor deposition coating of aluminum over the surface of a 75-μm polyethylene terephthalate film and had a surface electrical resistance of $10^3$ Ω) and then dried, thereby forming a charge generating layer of 1 μm in thickness.

Subsequently, a solution obtained by dissolving 4 parts of the charge transporting compound of the following structural formula

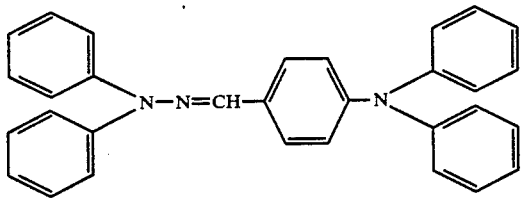

and 4 parts of bisphenol A polycarbonate in 13.3 parts of dichloromethane and 26.6 parts of 1,2-dichloroethane was coated on the above-obtained charge generating layer by means of a wire wound rod, and then dried, thereby forming a charge transporting layer of 11 μm in thickness. Thus, an electrophotographic photoreceptor having a two-layer structure was produced.

Using an electrostatic copying paper testing machine (model SP-428, manufactured by Kawaguchi Denki K.K., Japan), the above-obtained electrophotographic photoreceptor was charged so as to have a potential of −600 V by means of corona discharge of −6 KV. Subsequently, the thus-charged photoreceptor was irradiated with light from a tungsten lamp having a color temperature of 3000° K. such that the surface of the photoreceptor had an illuminance of 2 luxes, and the time period required to reduce the surface potential to half the initial surface potential was measured. From the reSults, the potential-halving exposure amount, $E_{50}$ (lux.sec), was calculated and was found to be 1.9 (lux.-sec). The above two procedures of charging and exposure were repeated 3000 times, and even after that, the $E_{50}$ a changed little.

EXAMPLES 2–10

Electrophotographic photoreceptors were prepared in the same manner as in Example 1 except that in place of the Resin (1), the compounds shown in Table 1 were used as resin binders for the charge generating layers, and their potential-halving exposure amounts ($E_{50}$) were evaluated.

TABLE 1

| Example | Resin No. | $E_{50}$ (lux · sec) |
|---|---|---|
| 2 | (2) | 1.8 |
| 3 | (4) | 2.0 |
| 4 | (5) | 2.6 |
| 5 | (6) | 1.5 |
| 6 | (7) | 2.4 |
| 7 | (8) | 2.2 |
| 8 | (10) | 2.5 |
| 9 | (12) | 2.0 |
| 10 | (13) | 2.1 |

Table 1 shows that the electrophotographic photoreceptors of the present invention have high sensitivity.

COMPARATIVE EXAMPLES 1–3

Electrophotographic photoreceptors were prepared in the same manner as in Example 1 except that in place of Resin (1), the following comparative compounds were used as resin binders for the charge generating layers, and their potential-halving exposure amounts ($E_{50}$) were evaluated. The results are shown in Table 2.

Comparative Compound

C-1 Styrene-maleic anhydride copolymer (molar ratio 1/1) (trade name SMA-1000, manufactured by Arco Chemical Company)

C-2 n-Butyl half-ester of styrene-methacrylic acid copolymer (molar ratio 1/1)

C-3 Styrene-butadiene copolymer (molar ratio 3/7) (trade name Tufprene, manufactured by Asahi Chemical Industry Co., Ltd., Japan)

TABLE 2

| Comparative Example | Comparative compound No. | $E_{50}$ (lux · sec) |
|---|---|---|
| 1 | C-1 | uncharged |
| 2 | C-2 | 150.1 |
| 3 | C-3 | 8.2 |

EXAMPLE 11

An electrophotographic photoreceptor of 12 μ in thickness was prepared in the same manner as in Example 1 except that aluminum chloride phthalocyanine was used in place of ϵ-type copper phthalocyanine.

This layered photoreceptor was charged so as to have a potential of −600 V by means of corona discharge of −6 KV. Subsequently, the decrease of the surface potential due to light was measured while the light from a 500W Xe lamp was being converted into monochromatic light by means of a monochromator (manufactured by Nikon Corporation, Japan) and allowed to strike upon the surface of the photoreceptor.

As a result, the potential-halving exposure amount, $E_{50}$ (erg/cm$^2$), at 800 nm was found to be 5.0 erg/cm$^2$, showing extremely high sensitivity.

EXAMPLES 12–17

Electrophotographic photoreceptors were prepared in the same manner as in Example 11 except that in place of Resin (1), the compounds shown in Table 3 were used as resin binders.

Their potential-halving exposure amounts, $E_{50}$, were measured, and the results are shown in Table 3.

TABLE 3

| Example | Resin No. | $E_{50}$ (erg/cm$^2$) |
|---|---|---|
| 12 | (2) | 5.4 |
| 13 | (3) | 4.9 |
| 14 | (5) | 7.2 |
| 15 | (9) | 5.6 |
| 16 | (10) | 6.1 |
| 17 | (12) | 5.8 |
| Comparative Example 4 | Comparative Compound No. C-3 | 18.3 |

As clearly shown by the above results, the photoreceptors of the present invention have high sensitivity. Further, they show only slight fluctuations in sensitivity even after repeated charging and exposure to light and, hence, are excellent in durability. These effects can be brought about by the layered electrophotographic photoreceptor which employs the combination of a phthalocyanine pigment with the above-mentioned copolymer of styrene and a half ester of maleic anhydride.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising an electrically conductive support having thereon at least a charge generating layer and a charge transporting layer, wherein said charge generating layer contains a phthalocyanine pigment and, as a resin binder, at least one copolymer which contains as recurring units at least styrene units and maleic anhydride half ester units represented by the following general formula (I):

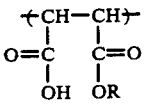

(I)

wherein R is selected from the group consisting of an alkyl group or an aryl group, and wherein said phthalocyanine pigment is selected from the group consisting of ϵ-type copper phthalocyanine pigment and aluminum chloride phthalocyanine.

2. An electrophotographic photoreceptor according to claim 1, wherein the substituents for the alkyl groups represented by R are selected from the group consisting of a halogen atom, a trifluoromethyl group, a nitro group, an amino group, a dialkylamino group, a carboxyl group, a sulfonic group, an alkoxy group, an aryl group and a cyano group, and wherein the substituents for the aryl groups represented by R are selected from the group consisting of a halogen atom, a trifluoromethyl group, a nitro group, an amino group, dialkylamino group, a carboxyl group, a sulfonic group, an alkoxy group, an aryl group, a cyano group and a lower alkyl group having 1 to 6 carbon atoms.

3. An electrophotographic photoreceptor according to claim 1, wherein the content of maleic anhydride half ester units in the copolymer ranges from 5 mol% to 95 mol% and the content of styrene units ranges from 95 mol% to 5 mol%.

4. An electrophotographic photoreceptor according to claim 1, wherein the content of maleic anhydride half ester units in the copolymer ranges from 20 mol% to 70 mol% and the content of styrene units ranges from 70 mol% to 20 mol%.

5. An electrophotographic photoreceptor according to claim 1, wherein the molecular weight of the copolymer is from 1,000 to 300,000.

6. An electrophotographic photoreceptor according to claim 1, wherein the ratio of the phthalocyanine dye to the resin binder and the charge generating layer is from 20:1 to 1:10.

7. An electrophotographic photoreceptor according to claim 1, wherein the ratio of the phthalocyanine dye to the resin binder in the charge generating layer is from 5:1 to 1:3.

8. An electrophotographic photoreceptor according to claim 1, wherein said copolymer of styrene and a half ester of maleic anhydride contain other recurring units than styrene units and maleic anhydride half ester units.

9. An electrophotographic photoreceptor according to claim 1, wherein R is a substituted or unsubstituted phenyl or naphthyl group.

* * * * *